US005639432A

United States Patent [19]

Carlson

[11] Patent Number: 5,639,432

[45] Date of Patent: Jun. 17, 1997

[54] METHOD AND APPARATUS FOR CARTON STERILIZATION

[75] Inventor: Leonard A. Carlson, Bloomington, Minn.

[73] Assignee: Tetra Laval Holdings & Finance S.A., Pully, Switzerland

[21] Appl. No.: 476,353

[22] Filed: Jun. 7, 1995

Related U.S. Application Data

[62] Division of Ser. No. 293,948, Aug. 24, 1994, Pat. No. 5,587,127, which is a division of Ser. No. 974,694, Nov. 12, 1992, Pat. No. 5,368,828.

[51] Int. Cl.[6] ..... A61L 2/06

[52] U.S. Cl. ..... 422/302; 422/300; 422/304; 422/307; 422/308

[58] Field of Search ..... 422/300, 302, 422/303, 304, 307, 308; 432/231

[56] References Cited

U.S. PATENT DOCUMENTS

| | | | |
|---|---|---|---|
| 2,080,482 | 5/1937 | Howard | 226/68 |
| 3,531,908 | 10/1970 | Rausings et al. | 53/37 |
| 3,566,575 | 3/1971 | Lisiecki | 53/37 |
| 3,879,795 | 4/1975 | Gfeller | 15/302 |
| 4,289,728 | 9/1981 | Peel et al. | 422/24 |
| 4,375,145 | 3/1983 | Mosse et al. | 53/425 |
| 4,560,567 | 12/1985 | Rausing | 426/399 |
| 5,163,487 | 11/1992 | Clüsserath | 141/92 |
| 5,350,568 | 9/1994 | Tuckner et al. | 422/304 |

FOREIGN PATENT DOCUMENTS 0394734 10/1990 European Pat. Off. .

OTHER PUBLICATIONS

"Effect of Chemical and Physical Strilants on Aseptic Packaging of Dairy Products", Patil et al., New Zealand Journal of Dairy Science and Technology, vol. 23, pp. 175–183 (1988).

*Primary Examiner*—Timothy McMahon

*Attorney, Agent, or Firm*—Burns, Doane, Swecker & Mathis, L.L.P.

[57] ABSTRACT

A method and apparatus for sterilizing preformed cartons prior to filling is disclosed. The interior of the cartons are first sprayed with a solution of hydrogen peroxide. The cartons are then treated with heated air to remove the hydrogen peroxide. The heated air is applied by means of a hollow mandrel having nozzles at one end. The mandrel corresponds generally to the shape of the carton. When the mandrel is inserted in the carton, air is directed against the interior side walls and bottom of the carton, and is exhausted from the carton by flowing upwardly between the side walls of the mandrel and the side walls of the carton.

4 Claims, 6 Drawing Sheets

20
24
28
22
34
28
30
40
30
22
34
40
40
40
26
38
40
40
26
38

Fig. 6
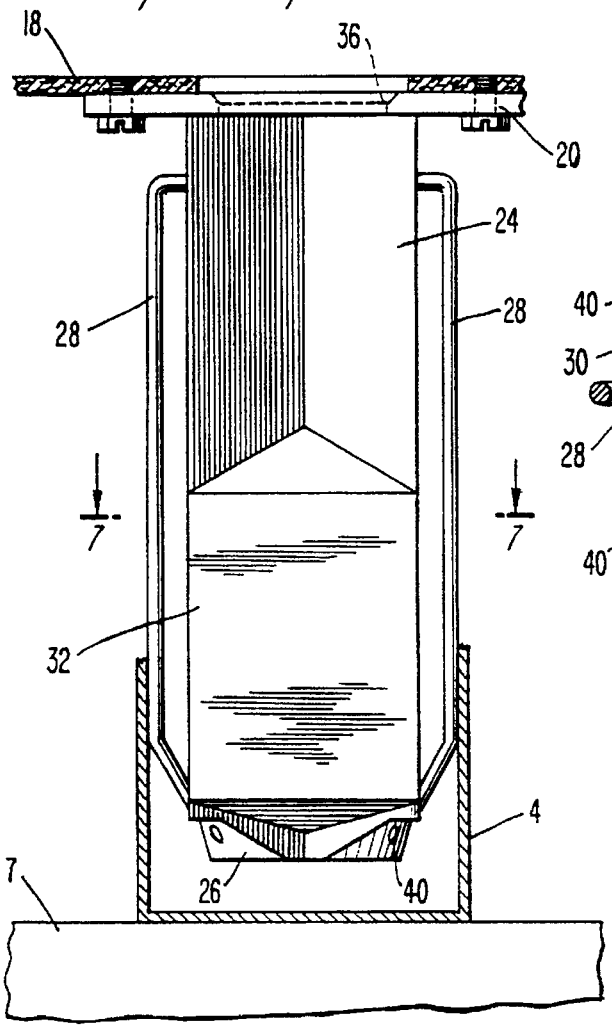
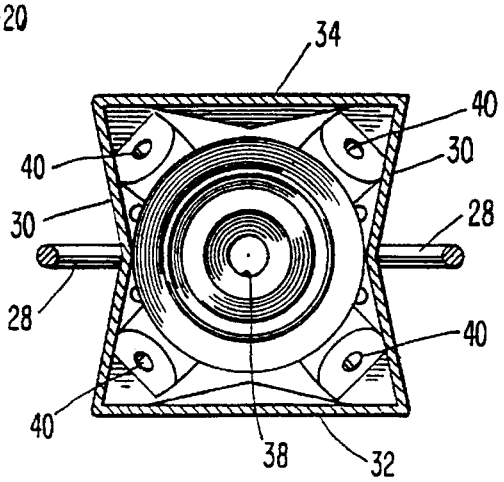
Fig. 7
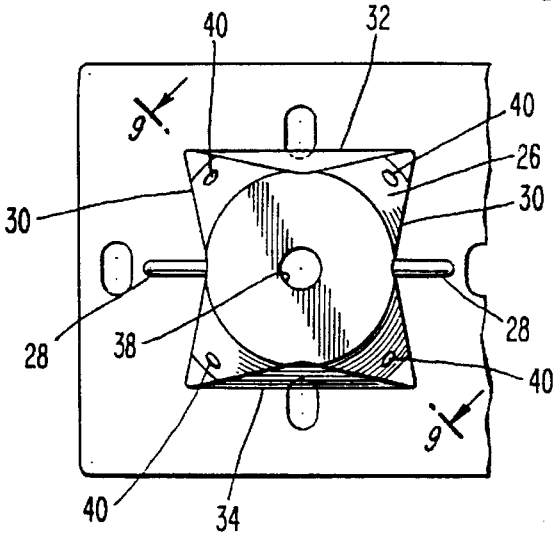
Fig. 8
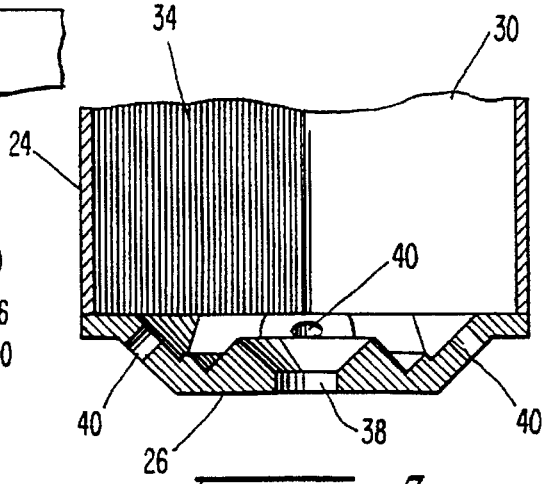
Fig. 9

METHOD AND APPARATUS FOR CARTON STERILIZATION

This application is a divisional of application Ser. No. 08/293,948, filed Aug. 24, 1994 now U.S. Pat. No. 5,587,127, which is a divisional of application Ser. No. 07/974,694, filed Nov. 12, 1992 now U.S. Pat. No. 5,368,828.

FIELD OF THE INVENTION

This invention relates to methods and apparatus for sterilizing cartons prior to filling, and more particularly to increasing the shelf life of food products in sealed paperboard cartons.

BACKGROUND OF THE INVENTION

Paperboard cartons are commonly used for packaging pasteurized and ultrapasteurized milk and juice products. Such products are commonly packaged in gable top cartons which are preformed with a closed bottom before being filled. Typically, the cartons are advanced through a filling machine on a conveyer. Before the cartons are filled, a hydrogen peroxide solution is sprayed into the interior of the carton to kill the bacteria that causes spoilage of the milk. Safety precautions must be used to prevent hydrogen peroxide from causing injury to the workers. Regulations of the Occupational Safety and Health Administration limit the amount of hydrogen peroxide permitted in the air where workers are present.

After the hydrogen peroxide solution is sprayed into the carton, it is necessary to dry the interior of the carton before the carton can be filled with milk or other food product. The hydrogen peroxide solution is removed from the interior of the carton in conventional filling machines by applying heated air to the interior of the carton. The conveyor that supports the cartons in the machine stops for a predetermined time interval to permit operations, such as filling, closing and sealing, to be performed on the carton in sequence. If an operation requires more time than the predetermined time interval, then it is necessary to increase the time interval, or provide additional stations where the operation is repeated one or more times. The manner of blowing heated air into the carton by conventional machines is insufficient to fully remove the hydrogen peroxide from the interior of the carton at one station, and it is necessary to provide several additional drying stations before the cartons can be filled with milk. The need for multiple drying stations in these prior packaging machines not only adds to the expense of the machines, but also limits the production rate of the machines.

OBJECTS AND SUMMARY OF THE INVENTION

It is an object of this invention to provide an improved method and apparatus for the sterilization of the interior of cartons with hydrogen peroxide solutions.

It is a further object of this invention to reduce the time required and the heat load for carrying out the sterilization of the interior of cartons.

Another object is to provide a hydrogen peroxide system that protects workers from the harmful effects of exposure to the chemical vapors.

These objects are accomplished in accordance with a preferred embodiment of the invention by a carton sterilization system that has two stations. In the first station, an atomized spray of hydrogen peroxide is applied to the interior surfaces of a preformed carton. At the second station, a mandrel is inserted into the carton. The mandrel has a plurality of nozzles which direct heated, sterile air against the interior surface of the carton. The flow of heated air and the pattern of the nozzles cause the hydrogen peroxide vapors and liquid droplets to be removed efficiently from the interior of the carton without substantially increasing the process time, and without requiring additional applications of heated air.

The mandrel reciprocates into and out of the carton and has a pattern of nozzle openings that provides a substantially uniform pattern of distribution of the heated air over the interior surface of the carton. Heating the hydrogen peroxide in this manner increases the effectiveness of the hydrogen peroxide, and causes the hydrogen peroxide vapor and droplets to be removed efficiently.

Preferably, the first and second stations are enclosed in a chamber to protect workers from the hydrogen peroxide vapor.

DESCRIPTION OF THE DRAWINGS

A preferred embodiment of the invention is illustrated in the accompanying drawings, in which

FIG. 6 is a side elevational view of one of the dryer mandrels;

FIG. 7 is a cross-sectional view of the dryer mandrel along the line 7—7 in FIG. 6;

FIG. 8 is a bottom plan view of the mandrel; and

FIG. 9 is a cross-sectional view of the mandrel along the line 9—9 in FIG. 8.

DETAILED DESCRIPTION

Figure 1:
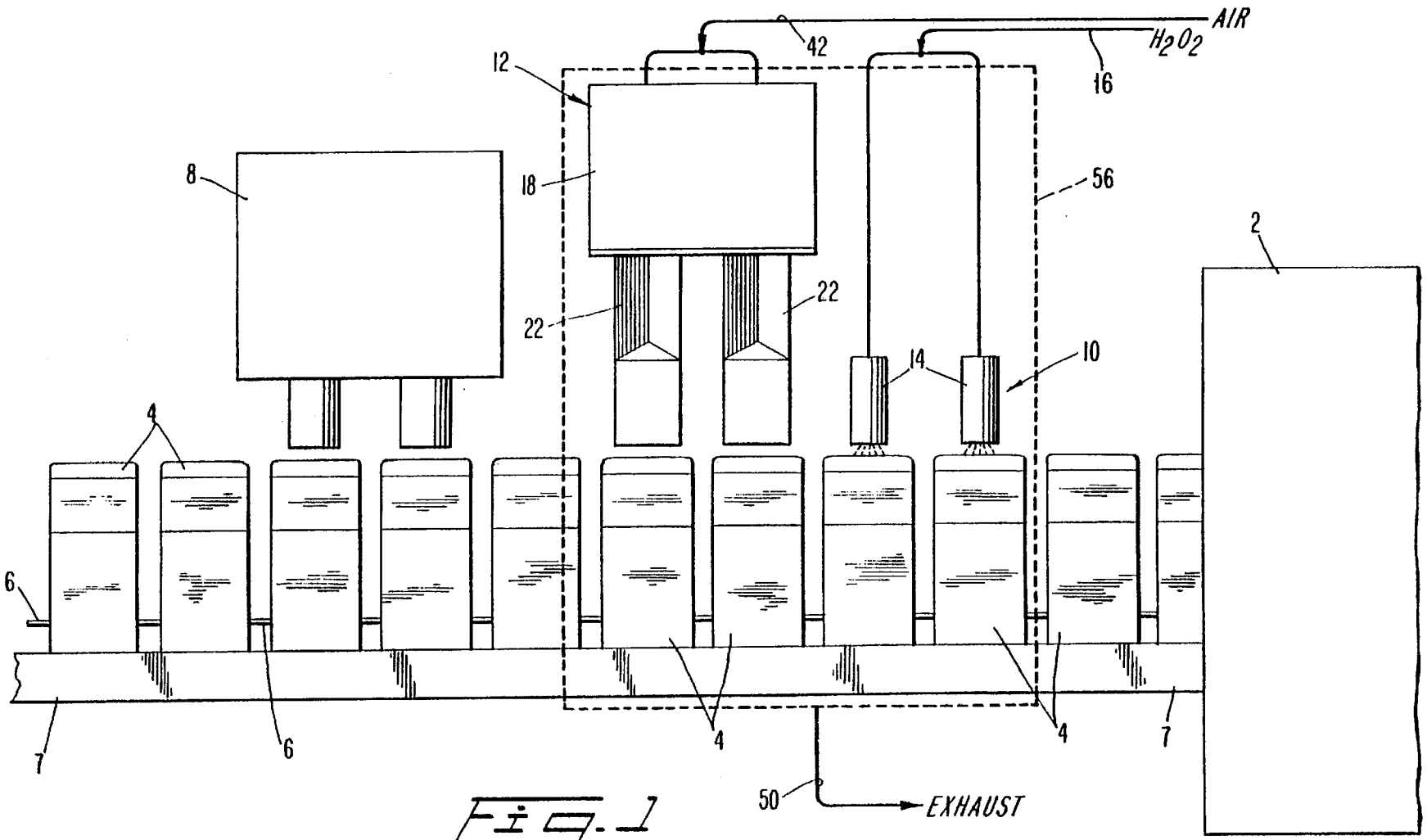
FIG. 1 is a schematic view of carton filling apparatus incorporating the carton sterilization system of this invention.

Referring to FIG. 1, the apparatus and process of this invention have been applied to a conventional automatic filling machine, such as the type disclosed in U.S. Pat. No. 4,448,008 for use in filling preformed cartons with liquid food products such as milk or juice. These conventional automatic filling machines are supplied with preformed blanks. The machine opens the blanks to form a tube, seals the bottom of the tube to form a carton with an open top, and places the carton on a conveyer. As the carton advances through the machine, it is filled with liquid food product, and then the top is closed and sealed. The filled carton is then conveyed out of the machine. The carton sterilization system of this invention is interposed between the formation of the carton and the filling of the carton.

Referring to FIG. 1, the carton formation apparatus 2 places cartons 4 in sequence on a conveyer 6. In accordance with conventional practice, the conveyer 6 advances intermittently two stations at a time, which allows two cartons to be filled simultaneously. The conveyor has a dwell time that allows sufficient time for carrying out the slowest operation in the machine. The system of this invention could be adapted to machines in which the cartons advance one station at a time or more then two stations at a time. The filling stations 8 are shown in FIG. 1. At the filling station, liquid food product is dispensed into the open top of the cartons by conventional dispensing equipment. Two cartons are filled simultaneously and then advance to the closing and sealing stations (not shown).

The sterilization system of this invention is interposed between the carton supply portion of the conveyer 6 and the filling station 8. The sterilization system includes a hydrogen peroxide spray system 10 and a heated air dryer station 12.

At the hydrogen peroxide spray station 10, two sprayers 14 are positioned over the cartons 4 to direct an atomized mist or spray onto the interior surfaces of the container. A solution of hydrogen peroxide is supplied through suitable conduits 16 to the sprays 14 and compressed air is supplied to the sprayers 14 to cause atomization of the hydrogen peroxide solution. The solution has a concentration of 0.1–15 percent hydrogen peroxide, and the flow rate through each nozzle is between 0.1 and 1.0 liters per hour. Preferably, the spray is in a full cone-shaped pattern to provide a uniform coating of the hydrogen peroxide solution on the interior side walls and bottom of the carton.

The hydrogen peroxide activated by heat, must be removed from the interior of the cartons 4 before they are filled with the liquid product, and this is done at the dryer station 12. The dryer station includes an insulated housing 18. A mounting plate 20 which is secured to the bottom of the housing 1B supports a pair of mandrels 22. As shown in FIGS. 5–9, the mandrels 22 are hollow and have a tubular portion 24 which is secured to the plate 20. The lower end of the tubular body 24 is covered by a nozzle plate 26. The tubular body also has a pair of guides 28 extending along opposite sides for engaging the interior walls of a carton to prevent the walls from collapsing against the side of the tubular body 24. As shown in FIG. 7, the side walls 30 of the tubular body 24 slope inwardly toward the longitudinal center line. The front and back walls 32, 34 are substantially flat at the lower end of the mandrel 22, while the portion of the front and back walls that is adjacent the plate 20 slopes inwardly in the same manner as the side walls 30. The plate 20 has an opening 36 that is aligned with the interior of the tubular body 24.

The nozzle plate 26 has a central nozzle 38 and corner nozzles 40 as shown in FIGS. 7–9. In FIG. 6, a representative bottom-sealed carton 4 is shown as positioned on the conveyer 6 to show the relationship between the nozzle plate 26 and the interior of the carton 4 when the mandrel is lowered into the carton.

Figure 2:
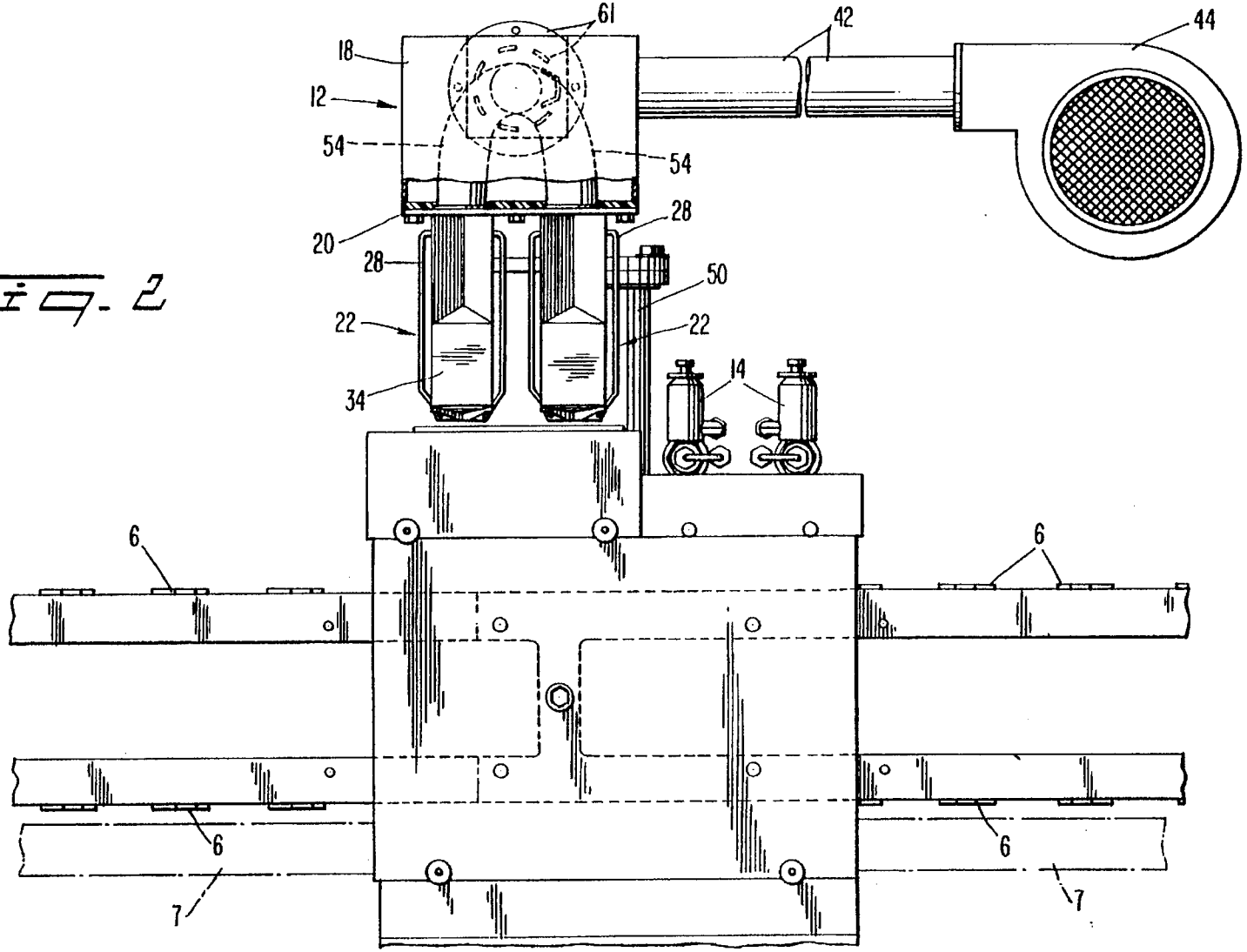
FIG. 2 is a side elevational view of the carton sterilization apparatus.
Figure 3:
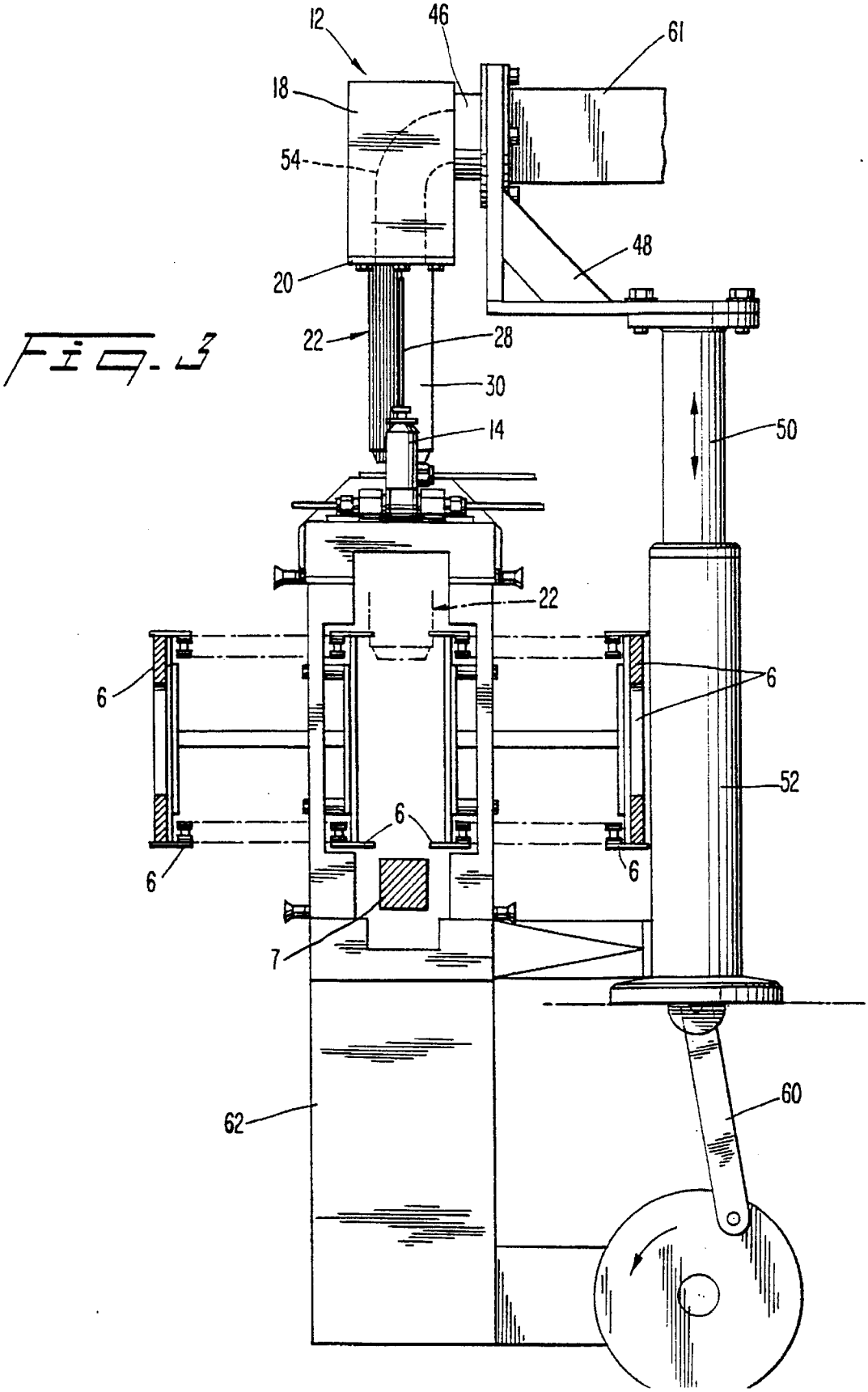
FIG. 3 is an end elevational view of the carton filling apparatus.
Figure 4:
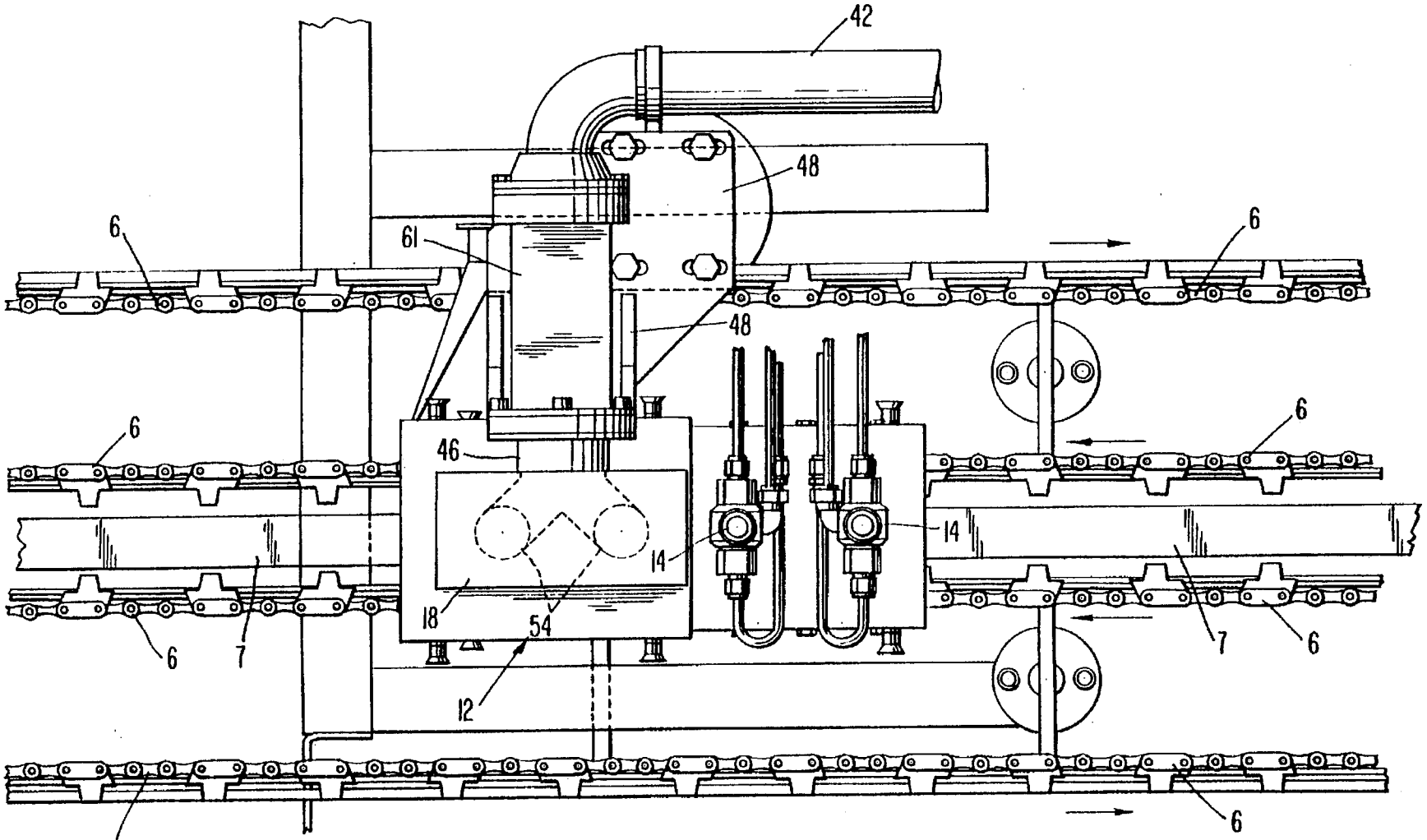
FIG. 4 is a top plan view of the carton filling apparatus.
Figure 5:
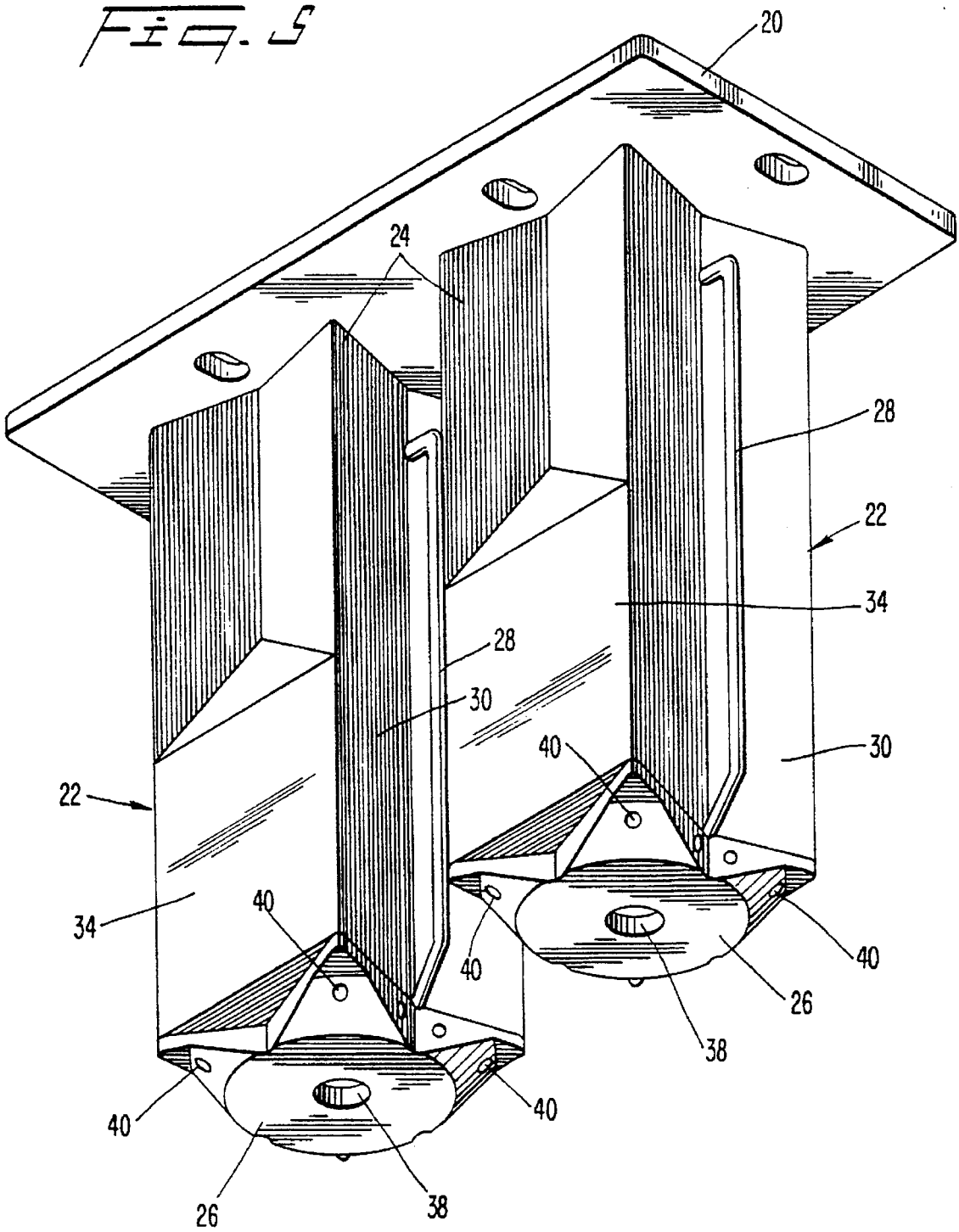
FIG. 5 is an isometric view of the dryer mandrels.

Referring to FIGS. 2–4, the mandrels 22 are attached to the housing 18 by means of the plate 20. Air is supplied to the housing 18 through a flexible conduit 42. Air under pressure is supplied to the conduit 42 by an air blower 44 or other suitable means. A pipe connector 46 provides a rigid mounting for the housing 18 on a mounting bracket 48. A heater unit 61 is mounted on the bracket 48 between the conduit 42 and the connector 46. The heater unit 61 may be an electrical resistance type, or any other suitable type for heating the air as it flows through the unit. The bracket 48 is mounted on a vertical shaft 50 which is mounted for reciprocating motions in a vertical sleeve bearing unit 52. A drive mechanism 60, which preferably is of the crank and link arm type, imparts vertical reciprocating motion to the shaft 50 in timed relation to the operation of the other components. Coordination of the conveyor 6 and the drive mechanism 60 is controlled by the machine drive 62. The mounting bracket 48 is shown near its uppermost position in FIGS. 2 and 3. Air from the conduit 42 is supplied to the interior of the mandrels 22 by a pair of pipes 54. Heating elements or other suitable means are provided in the heater unit 61 to transfer heat to the air flowing through the pipes 54. The temperature of the air flowing out of the nozzle plate 26 should be at least 715° F. for small cartons and at least 1000° F. for large cartons. The maximum temperature of the air should be less than the temperature that will cause damage to the carton material. To avoid overheating carton material which typically has a polyethylene coating, the temperature of the air flowing from the nozzles should be about 715° F. for the smallest containers and about 1050° F. for the tallest containers. The flow rate of air through each mandrel 22 is preferably 10–15 cfm.

Since the apparatus of this invention is intended to be used with cartons of different heights, it is necessary to adjust the operating conditions depending on which size of carton is being processed. The quantity of hydrogen peroxide spray for each carton should be proportioned to the surface area of the carton side walls and bottom. The sprayers 14 have conventional controls which adjust the flow rate of the solution and the air pressure to achieve the desired degree of coating of the carton surfaces. The temperature of the air and the flow rate of the heated air used for drying the cartons must also be adjusted in relation to the size of the cartons. The stroke of the mandrels is the same for all sizes of cartons, preferably 6.3 inches, and for short cartons, the ratio of penetration of the mandrel 22 to the height of the carton is more than for taller cartons. As shown in FIG. 3, the conveyor 6 has a support plate 7 which is adjustable so that the top of the carton will be positioned at the proper height for receiving the mandrel 22 and for being filled and sealed, regardless of which size carton is being filled and sealed.

As shown in FIG. 1, the hydrogen peroxide sterilization station 10 and the dryer station 12 are preferably enclosed within a housing 56. The housing 56 has openings at opposite ends to allow the cartons to enter and leave the housing. The air flow through the exhaust line 58 should be greater than the air flow into the enclosure at each end where the cartons enter and leave and from the nozzles in the nozzle plate 26, so that hydrogen peroxide vapors do not escape from the enclosure but are directed through the exhaust line to be collected and treated before being returned to the atmosphere.

In operation, cartons 4 are formed and placed on the conveyer 6. The conveyer advances intermittently a distance that corresponds to the spacing between two cartons, so that two cartons are treated simultaneously at each station. The dwell time of the conveyor is selected to be long enough to carry out the necessary operation at each station, and since a continuous conveyor is used, the longest required dwell time controls the timing of the conveyor. The cartons then advance to the sterilization station 10. A spray nozzle sprays hydrogen peroxide solution into the interior of each carton to form a coating of the hydrogen peroxide solution on the interior surface of the carton. The cartons next advance to the dryer station 12. The mandrels 22 are initially raised to the position shown in full lines in FIG. 2. The blower 44 is operated so that a stream of air is flowing through the conduit 42 and through the pipes 54 to the interior of the mandrels 22. By operating the mechanism 60, the bracket 48 lowers the mandrels 22 from the position shown in FIG. 3 into the interior of the cartons on the conveyer until the mandrels reach the position shown in FIG. 6 relative to the support plate 7 of the conveyer 6. Air from the conduit 42 is heated as it passes through the heater unit 61. The hot air flows out through the nozzles 38 and 40 in the nozzle plate 26 and then upwardly along the guides 28 until it flows out through the top of the carton 4. The stroke of the mandrels 22 is the same for small cartons of limited height as it is for taller cartons, since an important feature of the invention is that this machine is easily converted for use with shorter cartons without having to adjust or change the stroke of the mandrels 22. After a predetermined period of time, the mandrels 22 are raised and the cartons then advance to the filling station 8 (FIG. 1).

As an example of the conditions that are appropriate for carrying out the process of this invention, the hydrogen peroxide solution should have a concentration of 0.1 to 15% of hydrogen peroxide, and preferably a concentration of 10%. The temperature of the heated air as it flows out of the nozzle plate is preferably between 1050° and 1100° F. for a 245 mm tall carton. The total flow rate is preferably 10 to 15 cu. ft. per minute. The vertical movement of the mandrels 22 is about 6.3 inches. Using these conditions, a satisfactory reduction of *B. subtilis* should be achieved.

By inserting the mandrels in the interior of the cartons and directing the high temperature air stream against the interior surfaces of the carton, and particularly against the bottom corners of the carton, residual quantities of hydrogen peroxide are substantially eliminated from the interior of the carton in a single step, so that the cartons can be filled immediately after passing through the dryer station 12. For taller cartons, heated air flows from the nozzles upwardly along the space between the walls 30, 32, 34 of the mandrel 22 and interior side wall of the carton to remove the hydrogen peroxide effectively. No additional drying treatment is required.

While this invention has been illustrated and described in accordance with the preferred embodiment, it is recognized that variations and changes may be made therein without departing from the invention as set forth in the claims.

What is claimed is:

1. Apparatus for providing a stream of heated air to the interior of cartons of the type having a preformed bottom and upright side walls, the apparatus comprising:

a hollow mandrel for being inserted into an open top of a carton, said mandrel having a tubular portion with opposite ends;

a nozzle plate secured on one end of said tubular portion, said nozzle plate having a plurality nozzles;

support means for supporting the other end of said tubular portion;

air conduit means on said support means; and heater means on said support means, said heater means being in communication with said air conduit means and said hollow mandrel so that air supplied to said air conduit means is heated in said heater means and flows through said tubular portion and through the nozzles in said nozzle plate to remove sterilization fluid from the carton upon insertion of the mandrel into the carton.

2. The apparatus according to claim 1, wherein said nozzle plate is substantially square and has a central nozzle and a nozzle at each corner for providing a uniform distribution of heated air to the interior of a carton.

3. The apparatus according to claim 1, wherein said tubular portion includes a pair of side walls and front and back walls, said side walls being inclined inwardly toward the center, and said mandrel includes a pair of guides extending longitudinally along the center of the side walls.

4. The apparatus according to claim 3, wherein said front and back walls each have a substantially flat portion adjacent said nozzle plate, and a portion adjacent said support means being inclined toward the center.

* * * * *